United States Patent [19]

Kobayashi

[11] Patent Number: 4,721,054

[45] Date of Patent: Jan. 26, 1988

[54] ANCHOR DEVICE

[76] Inventor: Satoru Kobayashi, 33-8 Taishido 5-chome, Setagaya-ku, Tokyo-to 154, Japan

[21] Appl. No.: 865,115

[22] Filed: May 20, 1986

[30] Foreign Application Priority Data

May 30, 1985 [JP] Japan ..... 60-115232

[51] Int. Cl.[4] ..... B63B 21/46

[52] U.S. Cl. ..... 114/299

[58] Field of Search ..... 114/299, 310, 311, 217, 114/378, 379; 294/66.1, 82.33; 43/17, 12, 17.2, 43.12, 43.4, 44.95; 244/137 R

[56] References Cited

U.S. PATENT DOCUMENTS

| | | | |
|---|---|---|---|
| 7,207 | 3/1850 | Bell | 114/311 |
| 2,490,460 | 12/1949 | McAvoy | 114/299 |
| 2,669,962 | 6/1954 | Christie | 114/299 |
| 2,764,116 | 9/1956 | Brewer | 114/299 |
| 3,150,629 | 9/1964 | Fields | 114/299 |
| 3,841,255 | 10/1974 | Mansfield | 114/299 |
| 4,565,026 | 1/1986 | Bohme | 43/17.2 |

FOREIGN PATENT DOCUMENTS

| | | | |
|---|---|---|---|
| 1328456 | 8/1973 | United Kingdom | 114/299 |

OTHER PUBLICATIONS

European Search Report, Application No. EP 86 30 3937, dated Oct. 29, 1986.

*Primary Examiner*—Joseph F. Peters, Jr.
*Assistant Examiner*—Jesûs D. Sotelo
*Attorney, Agent, or Firm*—Laff, Whitesel, Conte & Saret

[57] ABSTRACT

An anchor device for anchoring a ship or boat, and being raised with minimal amount of hoisting power. A flexible rope having a free end with a retaining device mounted on the rope, for detachably retaining the free end of the rope. Attached to the rope is the anchor, which has a shank and at least one grasping or holding member extending backwardly from one end of the shank for grasping a rock or for holding a solid mass at the bottom of the body of water. The anchor is attached to the rope so that the one end of the anchor which is formed with the grasping or holding member is positioned remote from the free end or the rope. A weight slides down the rope and strikes the retaining device to release the free end of the rope from said the retaining device, in readiness for raising the anchor.

15 Claims, 20 Drawing Figures

ANCHOR DEVICE

BACKGROUND OF THE INVENTION

1. Field of the Invention

The present invention relates to an anchor device for anchoring a ship or boat.

2. Related Art Statement

In order to anchor a ship fixedly at a desired position, an anchor used for such purpose must have large arms and flukes or like means for holding a large amount of sand, soil or like at the bottom of the water or have sharp bills for firmly grasping a rock at the bottom of the water. However, it is often hard to release an anchor having sharp bills from a rock. On the other hand, in order to have a sufficient anchoring power by holding the sand or soil, a large amount of sand or soil should be held by the flukes and arms of the anchor. However, when it is desired to raise the anchor which has held a large amount of sand or soil, the anchor rope must be hoisted by an extremely high power.

As one approach for solving the aforementioned problems, an anchor device shown in FIGS. 14 and 15 has been proposed by Japanese Utility Model Application No. 135965/1975 (laid open to the public by Japanese Utility Model Laid-Open Publication No. 49493/1977). This prior art anchor device 1 comprises a shank 2 having one end formed with an integral fluke 3 bend backwardly and the other end provided with a ring 5. A portion of the ring 5 is cut away to form a slit 4, and a locking lug 6 of a rotatable fitting 7 is retained by the ring 5. As shown in FIG. 14, the locking lug 6 extends substantially along a diametral direction of the ring 5 and confined by the peripheral wall of the ring 5 when the anchor device 1 is in the anchoring position. The fitting 7 is formed with an eyelet at the end opposing to the locking lug 6, and one end of a rope 8 is tied to the eyelet. The end of the fitting 7 provided with the eyelet is also connected with one end of a chain 9, and the other end of the chain 9 is connected to the crown, i.e. the end of the shank 2 from which the bent fluke 3 extends. When the fitting 7 is rotated to the position shown in FIG. 15 and the rope 8 is drawn upwardly, the locking lug 6 passes through the slit 4 so that the fitting 7 is released from the ring 5, as will be readily understood from FIG. 15.

When the anchor device 1 is used in the anchoring position as shown in FIG. 14, the force pulling the rope 8 in the left direction as viewed in FIG. 14 is transmitted through the fitting 7, the ring 5 and the shank 2 to the fluke 3 which resists the pulling force to anchor the ship in position. When it is desired to raise the anchor device 1, the ship is moved so that the fitting 7 is rotated by the rope 8 to align the locking lug 6 with the slit 4, as shown in FIG. 15, to release the locking lug 6 from the ring 5 and to separate the fitting 7 from the end of the shank 2 formed with the ring 5. As the result, the pulling force applied from the rope 8 is transmitted through the chain 9 directly to the crown or the root portion of the fluke 3, so that the fluke 3 is raised with its sharp force end oriented downwardly to make it possible to hoist the rope 8 with a little power.

However, this prior art anchor device has a disadvantage that the ship must be moved to rotate the fitting 7 so as to release the locking lug 6 from the ring 5. Such a locomotion or movement of the ship necessary for separating the fitting 7 from the ring 5 is often impossible, for example, when the ship is stayed in a small bay or near a reef or shore. In such a case, this prior art anchor device cannot exert the designed performance characteristic, and thus fails to take advantage of reducing the power required for hoisting the rope. Another more serious problem involved in this prior art anchor device is the lack of reliability. In detail, if the ship lying at the anchor device is unintentionally moved by the ebb and flow of tide or by the change in current to result in rotation of the fitting 7 at the position shown in FIG. 15, the fitting 7 would be eventually separated from the ring 5 spontaneously, whereupon the grasping force of the anchor device is significantly reduced.

Another proposal has been made by Japanese Utility Model Application No. 132222/1981 (which was laid open to the public by Japanese Utility Model Laid-Open Publication No. 36993/1983). In the anchor device disclosed by this publication, the lower end of a rope is connected to the end of the shank, from which end the grasping flukes The rope is tied to the other end of the shank opposite to said one end by a relatively weak string. With this construction, when any one of the flukes bites into a rock at the bottom of the water to make it extremely hard or even impossible to release the pawl from the rock, a pulling force sufficiently high to break the relatively weak string is applied through the rope to cut the string so as to separate the rope from said other end of the shank, whereupon the pulling force transmitted through the rope is directly applied on the crown end of the shank, i.e. the root ends of the grasping pawls, so that the anchor is raised with the pawls oriented downwardly by a little raising or hoisting force. However, the anchor device of such construction is not reliable, since the relatively weak string is apt to be broken unintentionally, for example, by a violent force of wave or wind at the stormy weather, leading to loss of anchoring function.

OBJECTS AND SUMMARY OF THE INVENTION

A principal object of this invention is to provide an anchor device which anchors a ship steadily and reliably with sufficient anchoring power and which may be raised easily from the bottom of the body of water with its grasping arm or pawl oriented downwardly by a reduced hoisting power.

Another object of this invention is to provide an anchor device having a foldable bag for containing therein a large amount of sand or soil to obtain sufficient anchoring power, the opening of the foldable bag being faced downwardly during the operation of raising the anchor device so that the sand or solid contained in the bag is discharged to reduce the force necessary for the anchor raising operation.

A further object of this invention is to provide an anchor device provided with a retaining means for retaining the anchor in the anchoring position reliably, the retaining means releasing the free end of the rope to move the anchor to a position ready for the anchor raising operation so that the anchor device can be raised by a little hoisting force.

A more specific object of this invention is to provide a retaining means for retaining the free end of the rope to hold the anchor in the anchoring position reliably and for releasing the free end of the rope to move the anchor to a position ready for the anchor raising operation.

The above and other objects and advantages of the present invention will become apparent from the following detailed description thereof.

The anchor device, provided by the present invention, comprises an anchor device comprising a flexible rope having a free end, retaining means for detachably retaining said free end of said rope and being attached to said rope and normally held at a position separated from said free end of said rope by a certain distance, anchoring means attached to said rope and having a shank and at least one grasping or holding member extending backwardly from one end of said shank, said anchoring means being attached to said rope such that said one end formed with said grasping or holding member is positioned remoter from said free end of said rope, and means for opening said retaining means so that said free end of said rope is released from said retaining means for ready for the anchor raising operation.

By the use of the anchor device of the invention, the pulling force transmitted from the rope is applied on the end of the shank opposing to the crown end from which the grasping or holding member extends when the anchor is retained in the anchoring position, whereas the pulling force transmitted through the rope is directly applied on the crown end of the shank from which the grasping or holding member extends thereby to reduce the force necessary for raising the anchor device during the anchor raising operation.

Figure 1A:
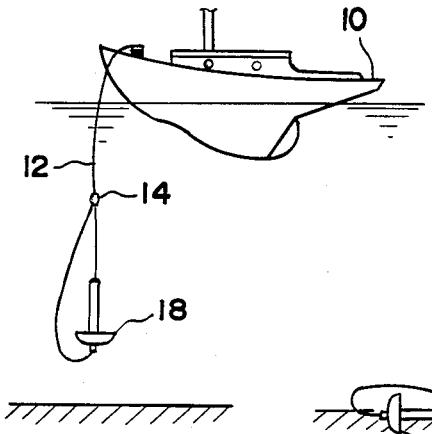
FIGS. 1(A) to 1(D) are schematic illustrations showing the principle and use of the anchor device of the invention.
Figure 1B:
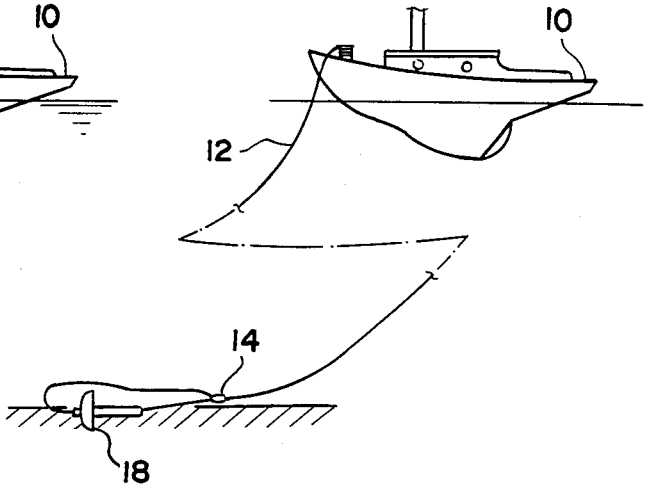
Figure 1C:
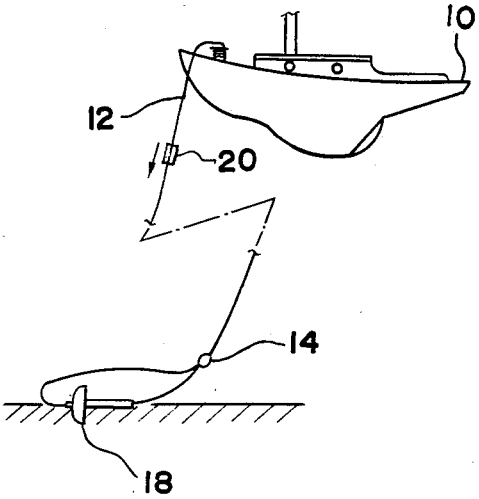
Figure 1D:
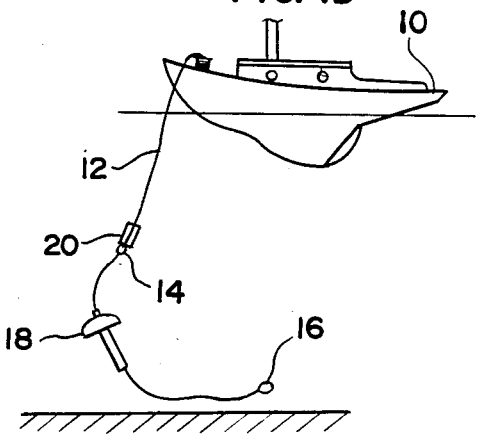

DETAILED DESCRIPTION OF THE INVENTION:

The present invention will now be described in detail by referring to some embodiments thereof.

First referring to FIG. 1, the principle of the invention will be described. In FIG. 1, a ship is denoted by reference numeral 10, from which a rope 12 extends with its lower free end lying on the bottom of the water. At a predetermined position at a certain distance from the lower free end, preferably at a position separated by three meters or more from the lower free end of the rope, a retaining means 14 is attached to the rope 12. The lower free end of the rope 12 is formed with an annular eyelet 16 which is to be held by the retaining means 14 so that the anchoring means 18 is retained in the anchoring position. The details of the retaining means 14 will be described hereinafter.

Intermediately of the retaining means 14 and the lower free end of the rope 12, an anchoring means 18, for example a mushroom type anchor, is attached to the rope 12 in the inverted posture. that is, the shank of the anchoring means 18 is oriented such that the crown end, from which the grasping member or fluke extends, is positioned closer to the retaining means 14, and the other end of the shank opposing to the crown end is positioned closer to the lower free end of the rope 12. It is preferred that the anchoring means 18 is slidable along the rope 12. However, the principle of the present invention will be described by referring to an embodiment having fixed anchoring means 18 for easy understanding thereof.

To attain the object of this invention, the anchoring means 18 shall be oriented such that the shank extends with the crown end positioned at the lowest side when the anchor device is laid on the bottom of the water, and that the shank extends substantially vertically with the crown end at the uppermost side during the operation of raising the anchor device. For this purpose, the crown end at the shank must be fixed to or stopped at a position closer to the lower free end of the rope 12 than the middle point of the extension of the rope 12 between the retaining means 14 and the free end of the rope 12.

The anchor device 10 is lowered into the water under the condition that the eyelet 16 is held by the retaining means 14 (see FIG. 1(A)). By paying out the rope, the anchoring means 18 reaches the ground or bed to engage a rock or to hold the sand or soil at the bed of the water, whereby the ship 10 is anchored (see FIG. 1(B)) fixedly in position. When it is desired to raise the anchoring means 18, the free end of the rope 12 is released from the retaining means 14. Release of the free end of the rope 12 is effected, for example, by dropping a weight 20 from the ship 10 along the rope 12 to impinge against the top face of the retaining means 14, whereby the retaining means is opened to release the eyelet 16 (see FIG. 1(C)). Thereafter, the pulling force transmitted through the rope 12 is applied directly on the crown end of the shank, so that the anchoring means 18 is raised with its grasping member oriented downwardly (see FIG. 1(D)). With this orientation, the flukes or other grasping means can be easily separated from the rock or other mass easily, and the sand or soild held or seized by the anchoring means 18 is discharged therefrom at the initial stage of the anchor raising operation.

A first embodiment of the anchor device of the invention having a first embodiment of the retaining means 14 will now be described with reference to FIGS. 2 to 5. In this embodiment, the anchoring means 18A is a conventional Danforth type anchor having a fluke assembly 50 which is swingable relative to a shank 52 within a certain angle. As will be seen from FIGS. 4 and 5, the retaining means 14A comprises a body segment 54 having a shape of inverted letter L and being provided with swivel joint 53 for serving as a untwisting mechanism for the rope 12, a hook segment 58 having a shape of letter J and having one end swingably hinged to a lower portion of the body segment 54, and a lock lever 60 for locking the upper end of the hook segment 58. The free end of the body segment 54 is bifurcated, as denoted by 62, to receive the upper end of the hook segment 58 for preventing the same from pivoting in the plane perpendicular to the drawing sheet. The hook segment 58 is locked by the lock lever 60 with the upper end thereof inserted in a hole formed at one end of the lock lever 60. An elongated hole 64 formed at the other end of the lock lever 58, and the rope 12 extends from the swivel joint 53 and passes through the elongated hole 64. The lock lever 60 is biased in the clockwise direction, as viewed in FIGS. 4 and 5, by a not shown torsion bar spring.

Figure 2:
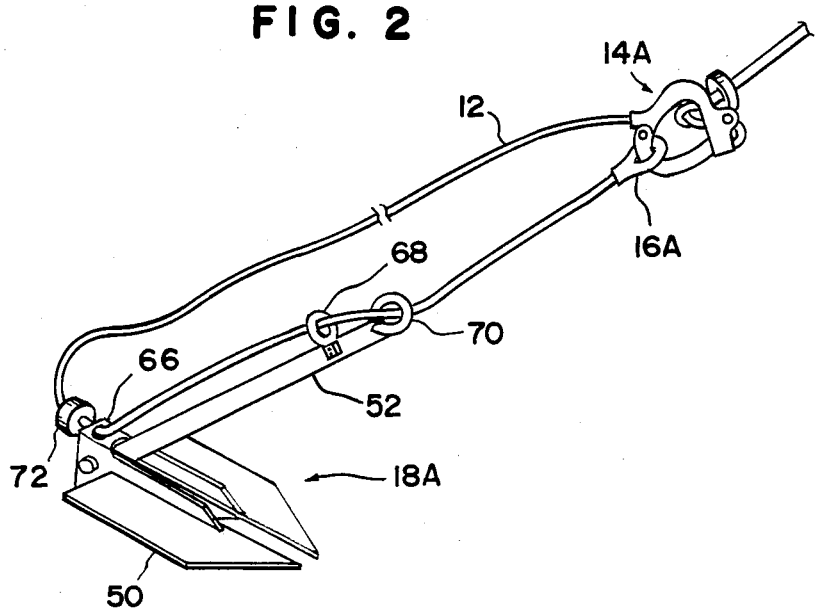
FIG. 2 is perspective view of a first embodiment of the invention.
Figure 3:
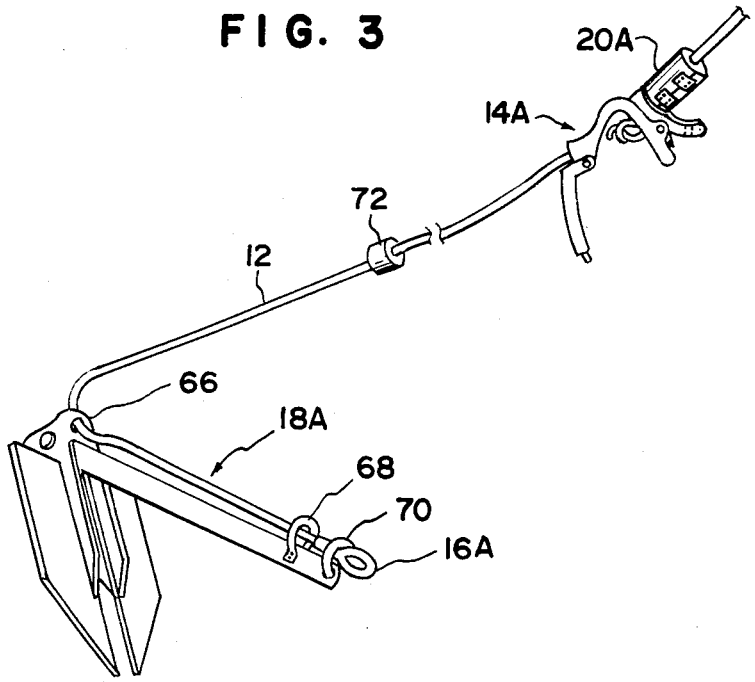
FIG. 3 is a perspective view of the first embodiment of the invention, with the retaining means releasing the lower free end of the rope so that the anchoring means is held at the anchor raising position.

As seen from FIGS. 2 and 3, the rope 12 further extends through a guide hole 66 formed at the base portion of the fluke assembly 50 and through a guide rings 68 and 70 disposed at the vicinity of the end opposing to the end at which the fluke assembly 50 is mounted. An eyelet 16A is attached to the free end of the rope 12. The eyelet 16A has an outer diameter larger than the inner diameter of the ring 70 so that it is engaged by the ring 70 to serve as a stopper when the anchoring means 18A is held in the anchor raising position.

A stopper 72 is fixed to the rope 12 at a position closer to the free end of the rope than the middle point of the extension of the rope 12 from the retaining means 14A to the eyelet 16A. By the provision of the stopper 72, the anchoring means 18A may be slidingly moved along the rope 12 extension from the stopper 72 and the eyelet 16A.

Figure 5:
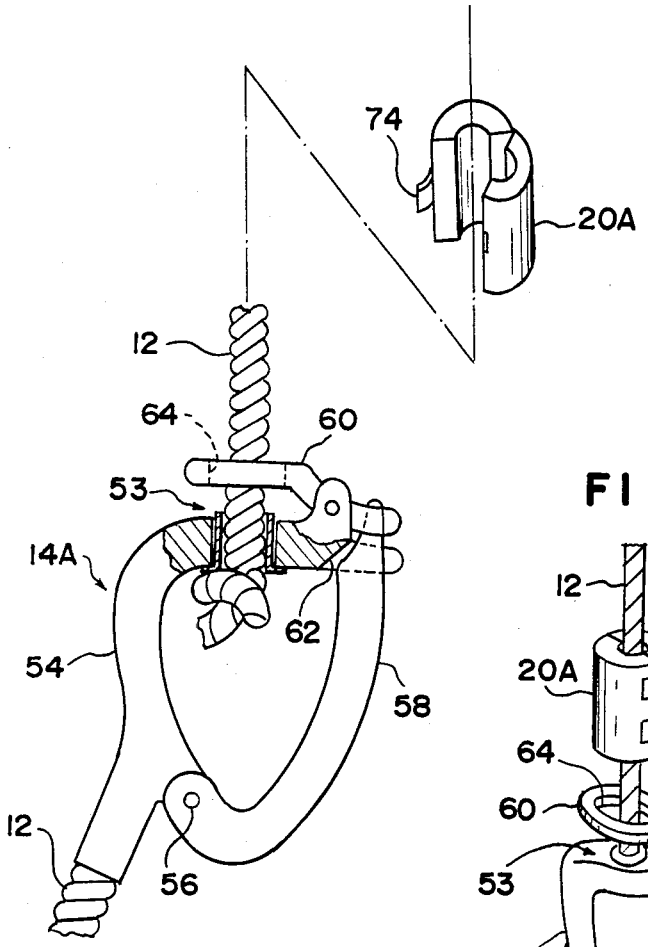
FIG. 5 is a sectional view of the retaining means shown in FIG. 4 after the free end of the rope is released therefrom, with the weight for opening the retaining means being shown perspectively for better understanding.

As best seen from FIG. 5, the weight 20A, which acts as the means for opening the retaining means 14, has a generally cylindrical shape and is made of two split pieces connected with each other by hinges. The weight 20A may be opened as shown in the upper right part of FIG. 5 and closed by a lock 74, as shown in FIG. 4, to be loosely fitted on the periphery of the rope 12 for sliding movement along the rope 12.

Figure 4:
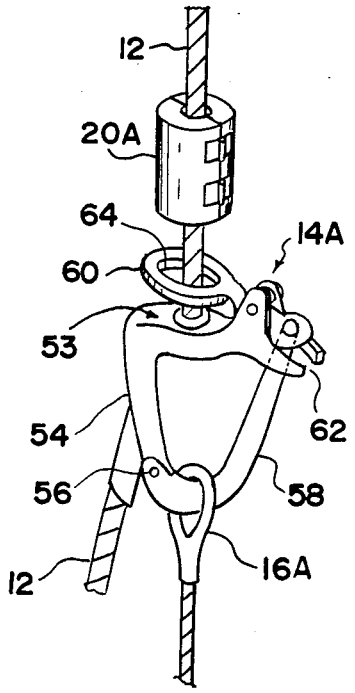
FIG. 4 is a perspective view of the retaining means of the first embodiment of the invention.

The eyelet 16A is retained by the hook segment 58, as shown in FIG. 4, when the first embodiment is dropped in the water. In this position, further movement of the anchoring means 18A toward the free end of the rope 12 is limited by the stopper 72. When it is desired to raise the anchor device, the weight 20A is attached to the rope 12 on the ship 10 and the weight 20A is allowed to fall downwardly along the rope 12. Upon impingement of the weight 20A against the lock lever 60, the lock lever 60 is swung in the counter-clockwise direction, as viewed in FIGS. 4 and 5, to release the hook segment 58, whereby the eyelet 16A is separated from the retaining means 14A. Then the rope12 is hoisted to raise the anchoring means 18A with the sharp ends of the fluke assembly 50 directing downwards, while the eyelet 16A is engaging with the ring 70.

In addition to the reduction of pulling force necessary for the anchor raising operation, this embodiment has a further advantage that the eyelet 16A is prevented from being caught by an obstacle, such as a rock, since the eyelet 16A is retracted to a position to be engaged by the ring 70.

Figure 6:
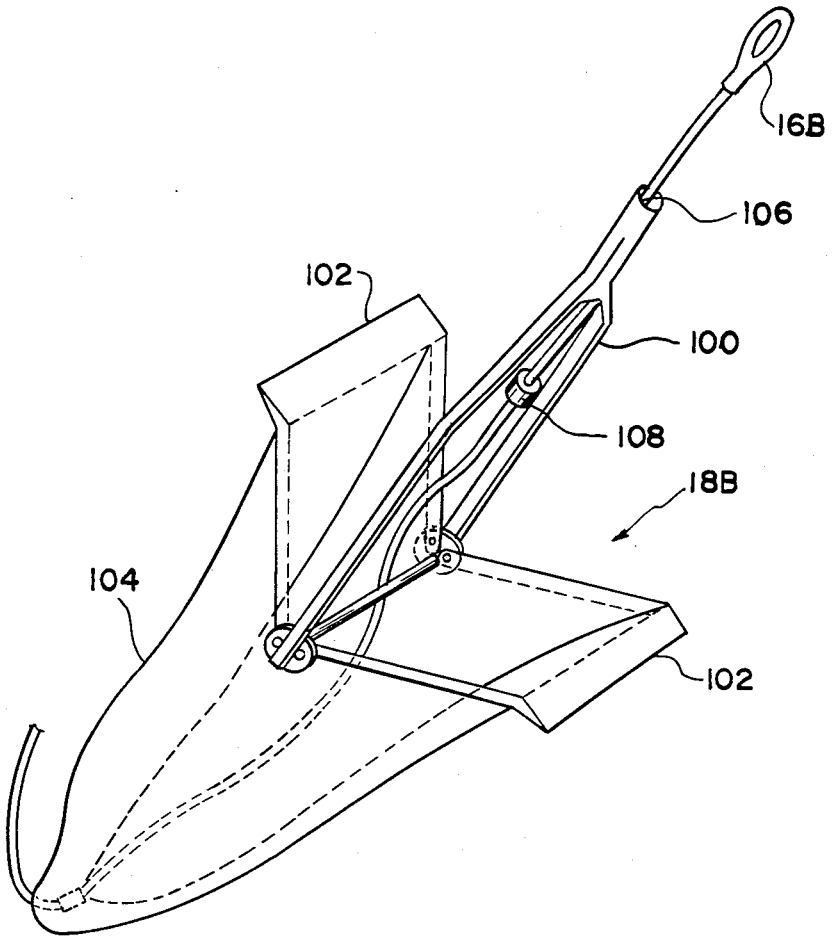
FIG. 6 is a perspective view of a second embodiment of the invention.
Figure 7A:
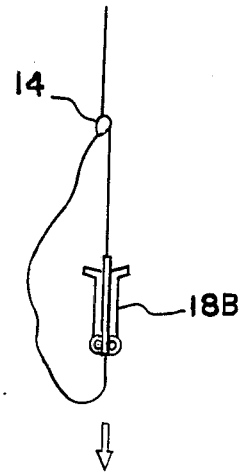
FIGS. 7(A) to 7(C) are schematic illustrations showing the used conditions of the second embodiment.
Figure 7B:
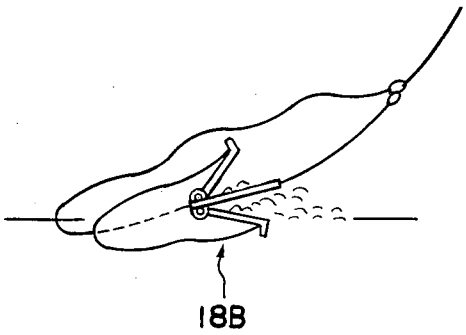

A second embodiment of the invention is shown in FIGS. 6 and 7. The anchoring means 18B of this embodiment comprises a shank 100 having biforked legs, a pair of frames 102, 102 each having a substantially rectangular contour, and a bag 104 having an opening edge fixed to the peripheries of the paired frames 102, 102. A rope 12 provided with an eyelet 16B at the free end thereof extends through a guide bore 106 of the shank 100, through a hole at the bottom of the bag 104. A stopper 108 is fixed to the rope 12 at a position intermediately of the extension of the rope 12 between the guide hole 106 of the shank 100 and the hole of the bag 104.

Figure 7C:
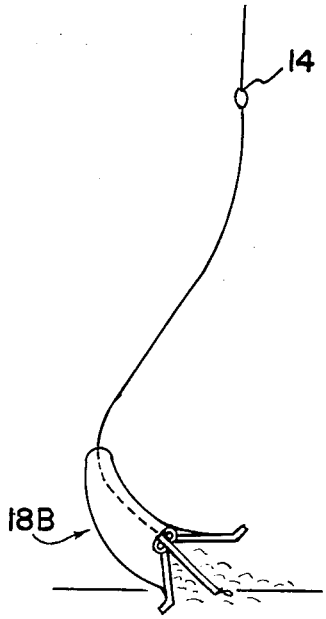

When this embodiment is dropped into the water, the frames 102 are closed and the bag 104 is folded within the space formed by the closed frames 102, as illustrated in FIG. 7(A). When the anchoring means 18B reaches the bottom of the water, the rope 12 is pulled to open the frames 102, 102 so that the bag 104 receives a large amount of sand or soil. The bag 104 containing a large amount of sand or soil becomes heavy enough for anchoring the ship in position. Prior to raise the anchoring means 18B, the eyelet 16B is released from the retaining means 14 and the rope 12 is pulled. As the rope 12 is pulled, the stopper 108 is moved to the position to be engaged with the bottom of the bag 104, and then the anchoring means 18B is raised while the bag is oriented with its opening facing down as shown in FIG. 7(C). The sand or solid contained in the bag 104 is thus discharged during the anchor raising operation, particularly at the initial stage of the anchor raising operation, to reduce the pulling force necessary for the raising operation.

Figure 8:
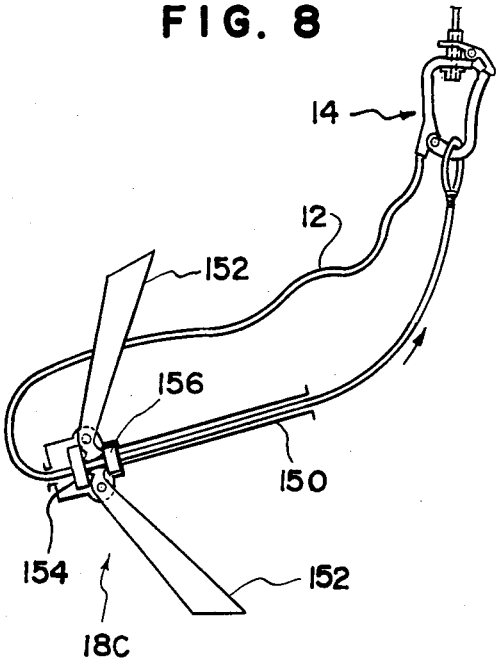
FIG. 8 shows a side elevation of a third embodiment of the invention with the anchoring means retained in the anchoring position.
Figure 9:
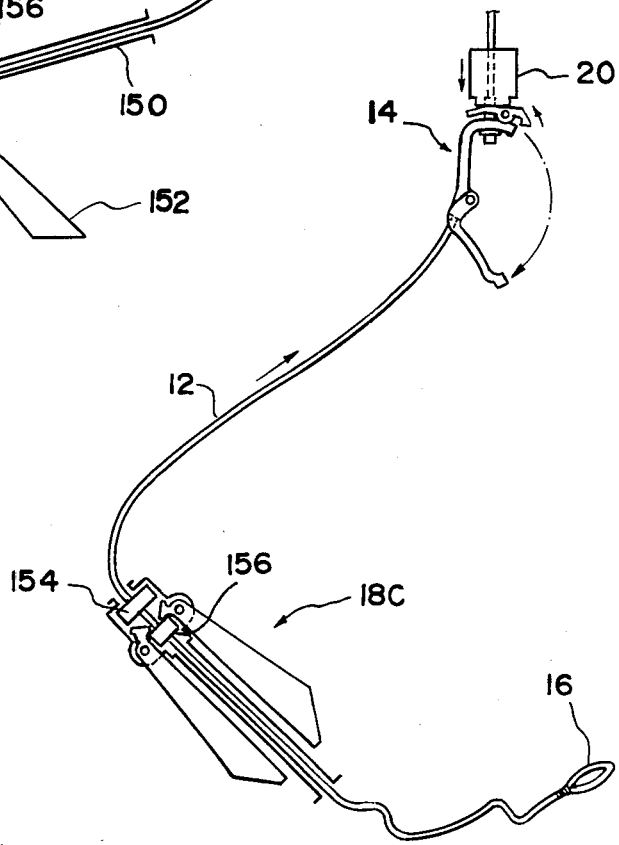
FIG. 9 shows a side elevation of the third embodiment during the anchor raising operation.

A third embodiment of the invention is shown in FIGS. 8 and 9, and comprises a folding anchor assembly 18C combined with the retaining means 14 according to the present invention. A plurality of flukes 152 are mounted on one end, i.e. the crown end or base end, of a generally cylindrical shank 150 through which a rope 12 extends. Paired retainers 154 and 156 coact with the base ends of the pawls and to retain them in the opened and closed positions, similarly as in the conventional folding anchor.

By pulling the rope after the folding anchor assembly 18C has reached the bottom of the water under the condition that an eyelet 16 attached to the free end of the rope 12 is retained by the retaining means 14, the flukes 152 are swung to the open position by the action of the retainer 154 to be ready for grasping a rock or other solid mass, as shown in FIG. 8. When it is desired to raise the anchor assembly 18C, the eyelet 16 is released from the retaining means 14 and then the rope 12 is hoisted, whereby the flukes 152 are swung to the closed position, as shown in FIG. 7, by the action of the retainers 156. With the flukes 152 folded to the closed position, the anchor assembly 18C may be easily raised.

Figure 10:
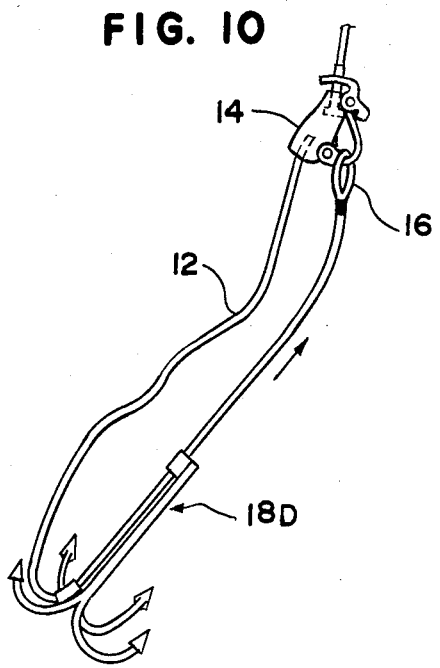
FIG. 10 is a perspective view of the fourth embodiment of the invention.
Figure 11:
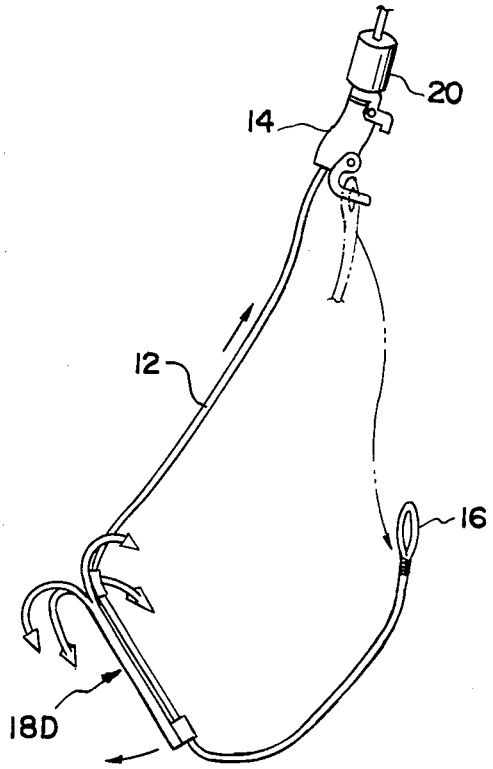
FIG. 11 is a perspective view showing the fourth embodiment during the anchor raising operation.

A fourth embodiment of the present invention is shown in FIGS. 10 and 11. In this embodiment, a four-fluke anchor 18D having a shank 200 is used as the anchoring means, and a rope 12 is fixed to the shank 200. This embodiment has a very simple construction with the anchor 18D fixedly secured to the rope 12, and yet realizes the advantageous functions of the invention. FIG. 10 shows the embodiment retained in the anchoring position with the eyelet 16 retained by the retaining means 14, and FIG. 11 shows the same during the anchor raising operation with the eyelet 16 being released from the retaining means 14. It is considered that not further description of the operation of this embodiment is needed for the understanding thereof.

Figure 12:
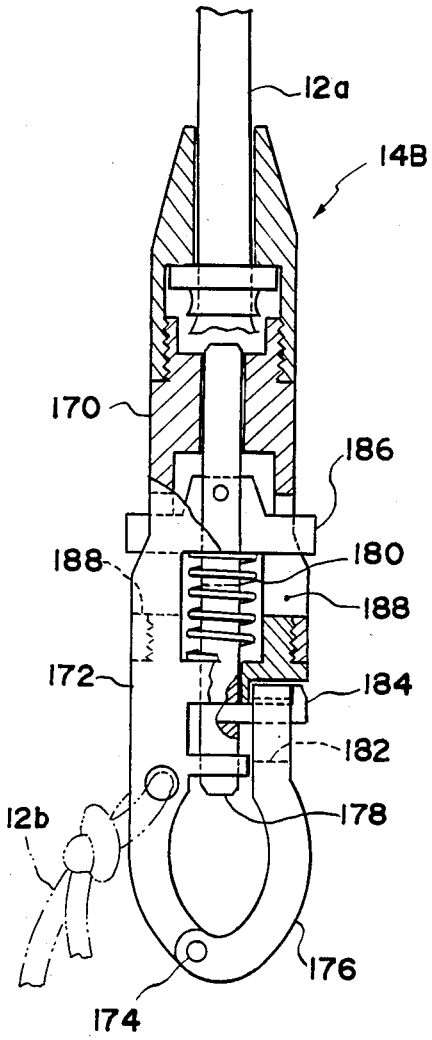
FIG. 12 is a sectional view showing another embodiment of the retaining means assembled in the anchor device of the invention.
Figure 13:
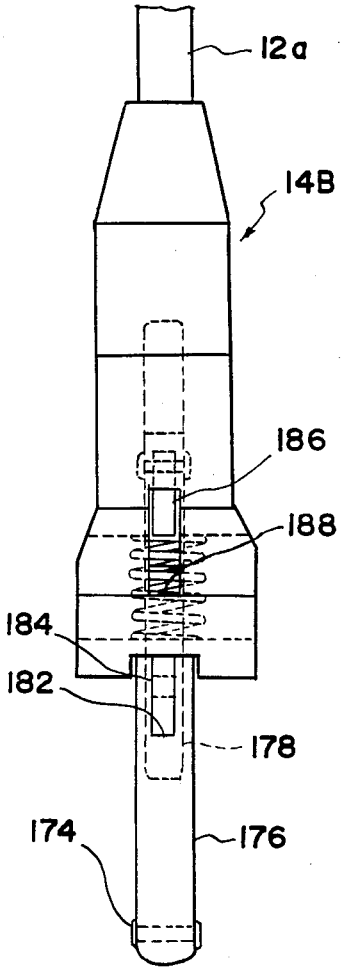
FIG. 13 shows a side elevation of the retaining means shown in FIG. 12.
Figure 14:
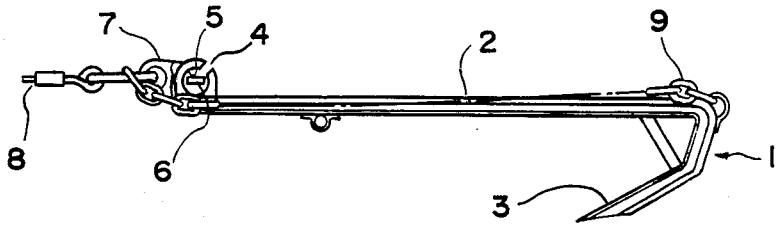
FIG. 14 is a side elevation of a prior art anchor device.
Figure 15:
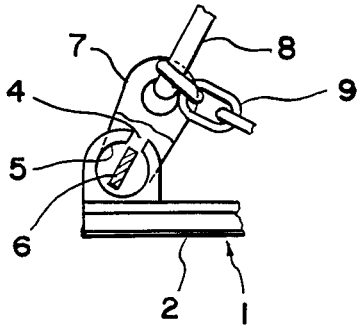
FIG. 15 is an enlarged view showing a portion of the prior art anchor device shown in FIG. 14.

A further embodiment of the retaining means is shown in FIGS. 12 and 13 and generally denoted by 14B. The retaining means 14B comprises a generally cylindrical housing 170 adapted to be mounted to a rope 12a connected to a ship or boat through a swivel joint, a fixed hook 172 integrally secured to the lower portion of the housing 170, a swingable hook 176 having one end pivoted to the lower end of the fixed hook 172 through a pin 174 and the other end provided with a vertically elongated slot 182, a lock rod 178 housed in the housing 170 to be moved along the axial direction of the housing 170, a coil spring 180 biasing the lock rod 178 upwardly, a lock claw 184 having a base end fixed to the lower portion of the lock rod 178 and a fore end which is trapped in the slot 182 to lock the swingable hook 176 when the lock rod 178 is in the upper lock position and adapted to be released from the slot 182 when the lock rod 178 is moved to the lower unlock position, and a swingable block 186 mounted to the lock rod 178 and having ends protruding beyond the outer peripheral wall of the housing 170 through vertically elongated windows 188, 188 provided through the diametrically opposed periphery of the housing 170, the protruding ends of the block 186 adapted to be impinged by a weight to be pushed downwards to move the lock rod to the lower unlock position.

Prior to raising the anchor device, a weight, which may be the weight 20A as shown in FIGS. 4 and 5, is allowed to fall down along the rope 12a so that the protruding ends of the block 186 is impinged thereby to be pushed downwardly, whereupon the lock rod 178 is moved downwards against the biasing force of the spring 180 to move to the lower unlock position at which the lock pawl 184 is released from the slot 182 of the swingable hook 176. The swingable hook 176 is thus swung about the pin 174 in the clockwise direction, as viewed in FIG. 12, so that the eyelet (not shown) fixed to the free end of the lower rope **12*b* having the upper end tied to the fixed hook 172 is released from the retaining means 14B**. Thereafter, the anchoring means may be raised with the flukes or holding members oriented downwardly by a relatively little hoisting force.

By the use of the retaining means 14B of this embodiment, even if either one of the protruding ends of the block 186 is impinged by a rock or otherwise applied with a shock, the lock rod 178 is prevented from moving to the lower unlock position, the shock causing only the swinging movement of the block 186. The block 186 and the lock rod 176 are urged to move to the lower unlock position only when both protruding ends of the block 186 are impinged by a weight fallen from the ship along the rope **12*a*. An accidental release of the free end of the rope 12*b* from the retaining means 14B** is thus prevented.

Although it has been described that the retaining means 14 is opened to release the free end of the rope **12*b* upon impingement by a weight 20**, release of the free end of the rope may be effected by other measures. For example, the retaining means may be opened by an electrically actuated system or may be opened by the use of a separate rope for opening the retaining means.

What is claimed is:

1. An anchor device comprising a flexible rope having a free end, retaining means having opened and closed positions for detachably retaining said free end of said rope, said retaining means being attached to said rope and normally held at a position which is separated from said free end of said rope by a certain distance, said retaining means opening responsive to a weight striking it, said retaining means holding said free end of said rope when said retaining means is closed, and said retaining means releasing said free end of said rope when said retaining means is opened, anchoring means having a shank and at least one grasping member extending backwardly from one end of said shank for grasping solid matter at the bottom of a body of water, said anchoring means being attached to said rope so that said one end having said grasping member is positioned remote from said free end of said rope, and said one end of said shank being secured to said rope at a position which is closer to said free end of said rope than to a middle point of the extension of said rope between said retaining means and said free end of said rope, and a weight slidably engaging said rope and dropped downwardly along said rope to impinge against said retaining means for opening said retaining means so that said free end of said rope is released from said retaining means in readiness for raising the anchor.

2. The anchor device according to claim 1, wherein said anchoring means is slidable along said rope, and further comprising a first stopper for limiting the sliding movement of said anchoring means toward said retaining means, and a second stopper for limiting the sliding movement of said anchoring means toward said free end of said rope.

3. The anchor device according to claim 1, wherein said anchoring means is fixed to a pre-set position of said rope.

4. The anchor device according to claim 1, wherein said grasping member is a fixed pawl having an arm and a fluke integral with said arm and provided with a sharp bill.

5. The anchor device according to claim 1, wherein said anchoring means is a mushroom type anchor.

6. The anchor device according to claim 1, wherein said grasping member is a pivotable fluke.

7. The anchor device according to claim 1, wherein said grasping member is a foldable bag which is adapted to be opened when said anchor device is in the anchoring position.

8. The anchor device according to claim 1, wherein said retaining means comprises a body segment to be secured to said flexible rope, a hook segment pivotably hinged to a lower portion of said body segment, and a lock lever having one end biased in a direction for releasingly locking the upper end of said hook segment and having another end provided with a through-hole for guiding said rope, said other end of said lock lever being struck by said weight to release said free end of said rope from said retaining means.

9. The anchor device according to claim 1, wherein said retaining means comprises a generally cylindrical housing to be fixed to said rope, a fixed hook integrally secured to the lower portion of said housing, a swingable hook having one end pivoted to the lower end of said fixed hook and the other end provided with a vertically elongated slot, a lock rod housed in said housing to be moved along the axial direction of said housing, a bias spring for biasing said lock rod upwardly, a lock claw having a base end fixed to the lower portion of said lock rod and having a fore end adapted to be trapped in said slot when said lock rod is in the upper lock position and adapted to be released from said slot when said lock rod is moved to the lower unlock position, and a swingable block mounted to said lock rod and having ends protruding beyond the outer peripheral wall of said housing, said protruding ends of said swingable block being struck by said weight to unlock said swingable hook so that said free end of said rope is released from-said retaining means.

10. An anchor device comprising a flexible rope having a free end, retaining means for detachably retaining said free end of said rope, said retaining means having an opened and a closed position and being attached to said rope at a position which is separated by a certain distance from said free end of said rope, said retaining means, said retaining means holding said free end of said rope when said retaining means is closed, and said retaining means releasing said free end of said rope when said retaining means is opened, anchoring means having a shank and at least one holding member extending backwardly from one end of said shank for holding a solid mass at the bottom of a body of water, said anchoring means being attached to said rope such that said one end formed with said holding member is positioned remote from said free end of said rope, with said one end of said shank secured to said rope at a position which is closer to said free end of said rope than a middle point of an extension of said rope between said retaining means and said free end of said rope, and a weight slidably engaging said rope and dropping downwardly to strike and impinge against said retaining means for opening said retaining means so that said free end of said rope is released from said retaining means in readiness for a raising of the anchor.

11. The anchor device according to claim 10, wherein said anchoring means is slidable along said rope, and further comprising a first stopper on said rope for limiting the sliding movement of said anchoring means toward said retaining means, and a second stopper on said rope for limiting the sliding movement of said anchoring means toward said free end of said rope.

12. The anchor device according to claim 10, wherein said anchoring means is fixed to a pre-set position of said rope.

13. The anchor device according to claim 10, wherein said holding member is a foldable bag which is adapted to be opened when said anchor device is in the anchoring position.

14. The anchor device according to claim 10, wherein said retaining means comprises a body segment to be secured to said flexible rope, a hook segment pivotably hinged to a lower portion of said body segment, and a lock lever having one end biased in a direction for releasingly locking the upper end of said hook segment and having another end provided with a through-hole for guiding said rope, said other end of said lock lever being struck by said weight so that said free end of said rope is released from said retaining means.

15. The anchor device according to claim 10, wherein said retaining means comprises a generally cylindrical housing to be fixed to said rope, a fixed hook integrally secured to the lower portion of said housing, a swingable hook having one end pivoted to the lower end of said fixed hook and the other end provided with a vertically elongated slot, a lock rod housed in said housing to be moved along the axial direction of said housing, a bias spring for biasing said lock rod upwardly, a lock claw having a base end fixed to the lower portion of said lock rod and having a fore end adapted to be trapped in said slot when said lock rod is in an upper lock position and adapted to be released from said slot when said lock rod is moved to a lower unlock position, and a swingable block mounted on said lock rod and having ends protruding beyond the outer peripheral wall of said housing, said protruding ends of said swingable block being struck by said weight sliding down said rope to unlock said swingable hook so that said free end of said rope is released from said retaining means.

* * * * *